US009127628B2

(12) United States Patent
Egawa

(10) Patent No.: US 9,127,628 B2
(45) Date of Patent: Sep. 8, 2015

(54) FLANGE FASTENING STRUCTURE

(75) Inventor: Takeshi Egawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 163 days.

(21) Appl. No.: 13/084,567

(22) Filed: Apr. 12, 2011

(65) Prior Publication Data

US 2011/0280682 A1 Nov. 17, 2011

(30) Foreign Application Priority Data

May 14, 2010 (JP) ..... 2010-111834

(51) Int. Cl.
*F02M 35/10* (2006.01)

(52) U.S. Cl.
CPC ..... *F02M 35/10085* (2013.01)

(58) Field of Classification Search
CPC ..... F16B 5/0241; F02M 35/10085
USPC ..... 285/368, 23, 24, 18, 325, 412; 411/104, 411/544, 111
See application file for complete search history.

(56) References Cited

U.S. PATENT DOCUMENTS 1,876,640 A * 9/1932 Dobson ..... 248/635
2,767,609 A * 10/1956 Cousino ..... 411/436
5,015,132 A * 5/1991 Turner et al. ..... 411/10
5,603,594 A * 2/1997 Lincoln ..... 411/84
5,655,865 A * 8/1997 Plank et al. ..... 411/85
5,685,679 A * 11/1997 Sugiura ..... 411/104
5,779,412 A * 7/1998 Nagai et al. ..... 411/85
5,833,417 A * 11/1998 Sargent et al. ..... 411/85
6,059,322 A * 5/2000 Nagai et al. ..... 285/125.1
6,146,071 A * 11/2000 Norkus et al. ..... 411/104
6,152,665 A * 11/2000 Wallace et al. ..... 411/11
2008/0181745 A1* 7/2008 Naik et al. ..... 411/107
2008/0298890 A1* 12/2008 Koike ..... 403/408.1

FOREIGN PATENT DOCUMENTS

EP 1666710 A2 * 6/2006 ..... F02D 9/10
JP 4065270 B2 6/2006
JP 2006161650 A * 6/2006
JP 2008-232039 10/2008

* cited by examiner

*Primary Examiner* — Daniel P Stodola
*Assistant Examiner* — James Linford
(74) *Attorney, Agent, or Firm* — Mori & Ward, LLP

(57) ABSTRACT

A flange fastening structure includes a first flange made of metal and a second flange made of plastic. Stepped nuts are provided in the second flange and each have a large-diameter portion and a small-diameter portion. The second flange has at least one raised portion on a surface of the second flange facing the large-diameter portion. The at least one raised portion is made of plastic. A height of the at least one raised portion is set such that the at least one raised portion pressed with the large-diameter portion is deformed when the first flange and the second flange are fastened together with bolts and the nuts. The small-diameter portion of each of the nuts contacts the first flange to limit fastening positions of the nuts and the bolts when the first flange and the second flange are fastened together with the bolts and the nuts.

12 Claims, 8 Drawing Sheets

FLANGE FASTENING STRUCTURE

CROSS-REFERENCE TO RELATED APPLICATIONS

The present application claims priority under 35 U.S.C. §119 to Japanese Patent Application No. 2010-111834, filed May 14, 2010, entitled "Flange Fastening Structure". The contents of this application are incorporated herein by reference in their entirety.

BACKGROUND OF THE INVENTION

1. Field of the Invention

The present invention relates to a flange fastening structure.

2. Description of the Related Art

Japanese Unexamined Patent Application Publication No. 2008-232039 discloses a technique in which, in an internal-combustion engine, a flange of an intake manifold is fastened with a bolt to a mounting surface of a cylinder head, with a plastic housing for a tumble control valve interposed therebetween. In this technique, a metal collar is embedded in the housing, and an annular raised base is formed on an end face of the housing that is in contact with the flange of the intake manifold. The raised base is formed such that it faces the periphery of the collar. The bolt passes through the flange and the collar and is screwed into the mounting surface of the cylinder head. While the raised base is being compressed by a fastening force of the bolt, the intake manifold and the housing are fastened together to the cylinder head.

Japanese Patent No. 4065270 discloses a technique in which, in an internal-combustion engine, a mating surface of a flange of a plastic intake manifold is fastened with bolts to an end face of a metal throttle body. In this technique, nuts are held in respective recessed portions formed in the flange of the intake manifold. Additionally, collars are embedded between the mating surface of the flange and the nuts. Then, the bolts inserted from the side of the throttle body are passed through the respective collars and screwed into the respective nuts.

SUMMARY OF THE INVENTION

According to one aspect of the present invention, a flange fastening structure includes bolts, a first flange, a second flange, and stepped nuts. The first flange is made of metal and is provided on a first member. The second flange is made of plastic and is provided on a second member. The stepped nuts are provided in the second flange and each have a large-diameter portion in contact with the second flange and a small-diameter portion extending from the large-diameter portion. The second flange has at least one raised portion on a surface of the second flange facing the large-diameter portion. The at least one raised portion is made of plastic. A height of the at least one raised portion is set such that the at least one raised portion pressed with the large-diameter portion is deformed by a predetermined amount when the first flange and the second flange are fastened together with the bolts and the nuts. The small-diameter portion of each of the nuts contacts the first flange to limit fastening positions of the nuts and the bolts corresponding to the nuts respectively when the first flange and the second flange are fastened together with the bolts and the nuts.

According to another aspect of the present invention, a flange fastening structure includes a first flange, a second flange, metal collars, bolts, and stepped nuts. The first flange is made of plastic and is provided on a first member. The second flange is made of plastic and is provided on a second member. The metal collars are provided in the first flange and each have a length substantially a same as a thickness of the first flange. The bolts are fitted into the metal collars to pass through the first flange, respectively. The nuts are provided in the second flange and each have a large-diameter portion in contact with the second flange and a small-diameter portion extending from the large-diameter portion. The second flange has at least one raised portion on a surface of the second flange facing the large-diameter portion. The at least one raised portion is made of plastic. A height of the at least one raised portion is set such that the at least one raised portion pressed with the large-diameter portion is deformed by a predetermined amount when the first flange and the second flange are fastened together with the bolts and the nuts. The small-diameter portion of each of the nuts contacts a corresponding collar among the collars to limit fastening positions of the nuts and the bolts corresponding to the nuts respectively when the first flange and the second flange are fastened together with the bolts and the nuts.

According to further aspect of the present invention, a flange fastening structure includes a first flange, a second flange, stepped bolts, and stepped nuts. The first flange is made of plastic and is provided on a first member. The second flange is made of plastic and is provided on a second member. The bolts pass through the first flange and each have a thick shaft portion having a length substantially a same as a thickness of the first flange and a thin shaft portion extending from the thick shaft portion and screwed into corresponding nut among the nuts. The nuts are provided in the second flange and each have a large-diameter portion in contact with the second flange and a small-diameter portion extending from the large-diameter portion. The second flange has at least one raised portion on a surface of the second flange facing the large-diameter portion. The at least one raised portion is made of plastic. A height of the at least one raised portion is set such that the at least one raised portion pressed with the large-diameter portion is deformed by a predetermined amount when the first flange and the second flange are fastened together with the bolts and the nuts. The small-diameter portion contacts the thick shaft portion to limit fastening positions of the nuts and the bolts corresponding to the nuts respectively when the first flange and the second flange are fastened together with the bolts and the nuts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
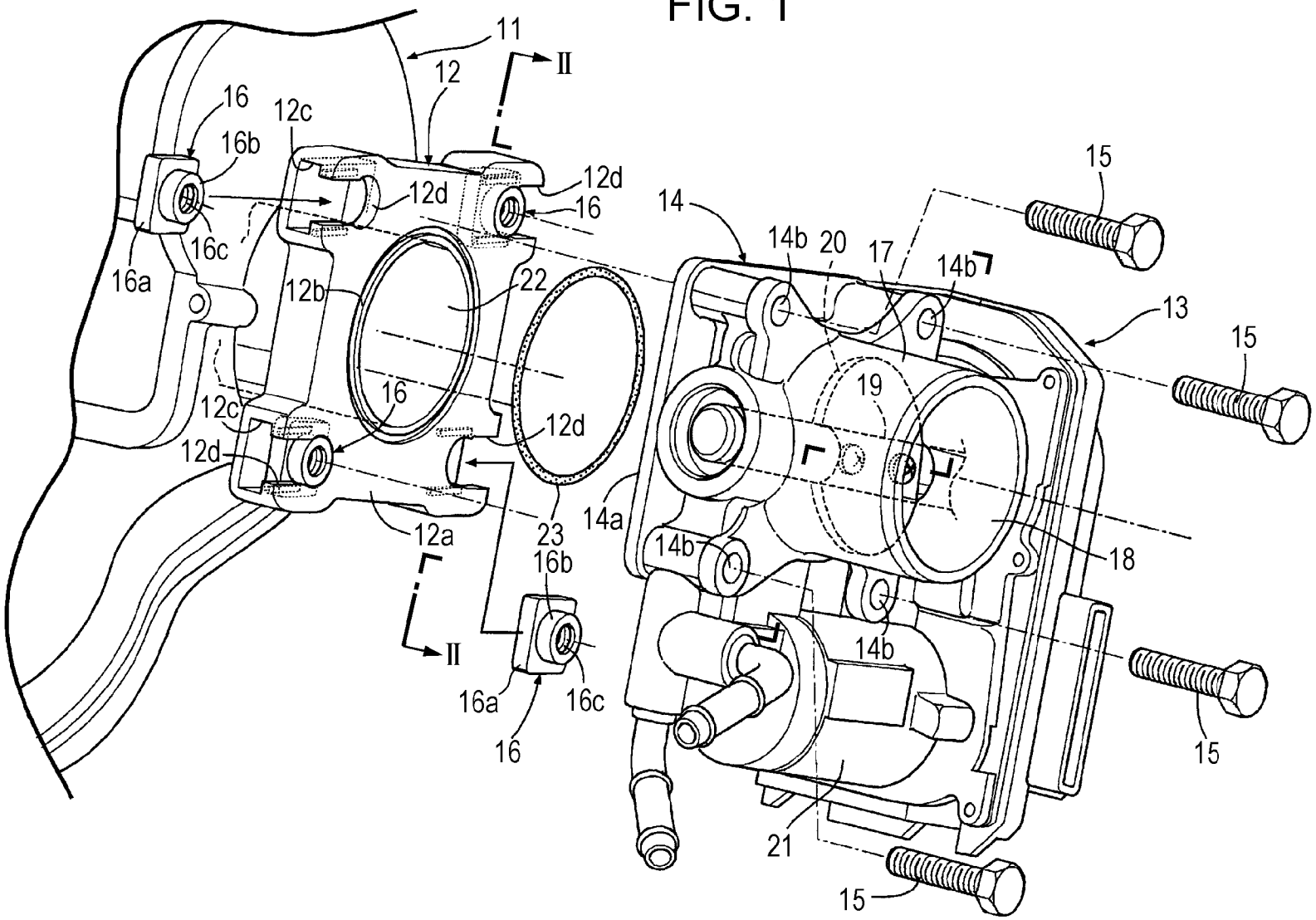
FIG. 1 is a perspective view of a connection between an intake manifold and a throttle body for an internal-combustion engine according to a first embodiment of the present invention.

The embodiments will now be described with reference to the accompanying drawings, wherein like reference numerals designate corresponding or identical elements throughout the various drawings.

A first embodiment of the present invention will now be described with reference to FIG. 1 to FIG. 4.

As illustrated in FIG. 1, a mounting flange 12 and a mounting flange 14 of a plastic intake manifold 11 and an aluminum alloy throttle body 13, respectively, for an internal-combustion engine are fastened together with four bolts 15 and four nuts 16. The mounting flange 12 is substantially rectangular in shape and is formed integrally with the intake manifold 11. The mounting flange 14 is also substantially rectangular in shape and is formed integrally with the throttle body 13. The throttle body 13 has a cylindrical portion 17 extending from the mounting flange 14. A throttle valve 20 supported by a valve shaft 19 is disposed inside an intake passage 18 that passes through the mounting flange 14 and the cylindrical portion 17. When an electric motor 21 in the throttle body 13 rotates the valve shaft 19, the throttle valve 20 rotates to change the opening of the intake passage 18. An intake passage 22 that passes through the mounting flange 12 of the intake manifold 11 communicates with the intake passage 18 of the throttle body 13. A flat mating surface 12*a* of the mounting flange 12 of the intake manifold 11 is to be in contact with a flat mating surface 14*a* of the mounting flange 14 of the throttle body 13. The mating surface 12*a* has an annular groove 12*b* surrounding the intake passage 22. An O-ring 23 is attached to the annular groove 12*b*.

Figure 2:
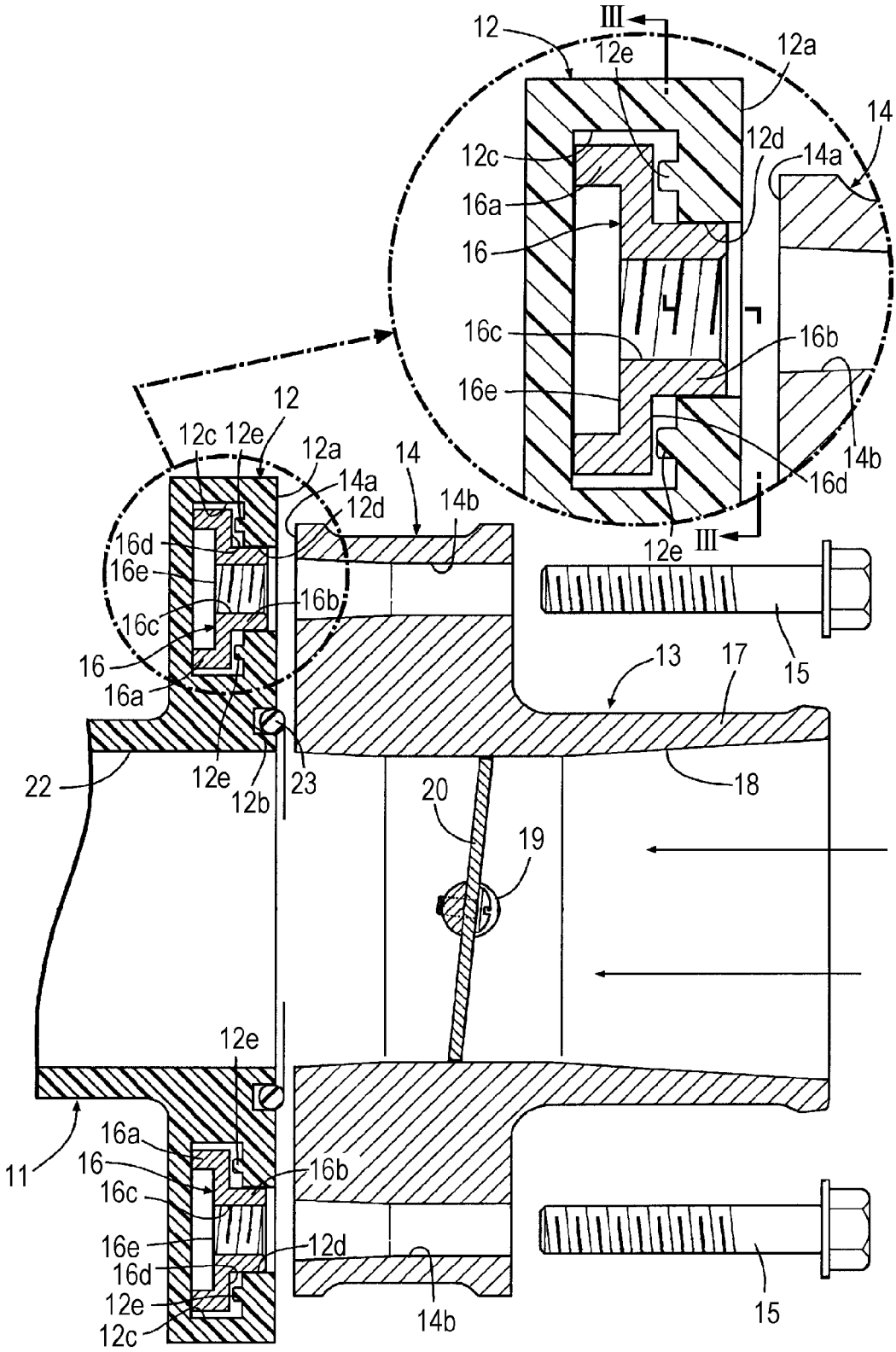
FIG. 2 is a cross-sectional view taken along line II-II of FIG. 1.
Figure 3:
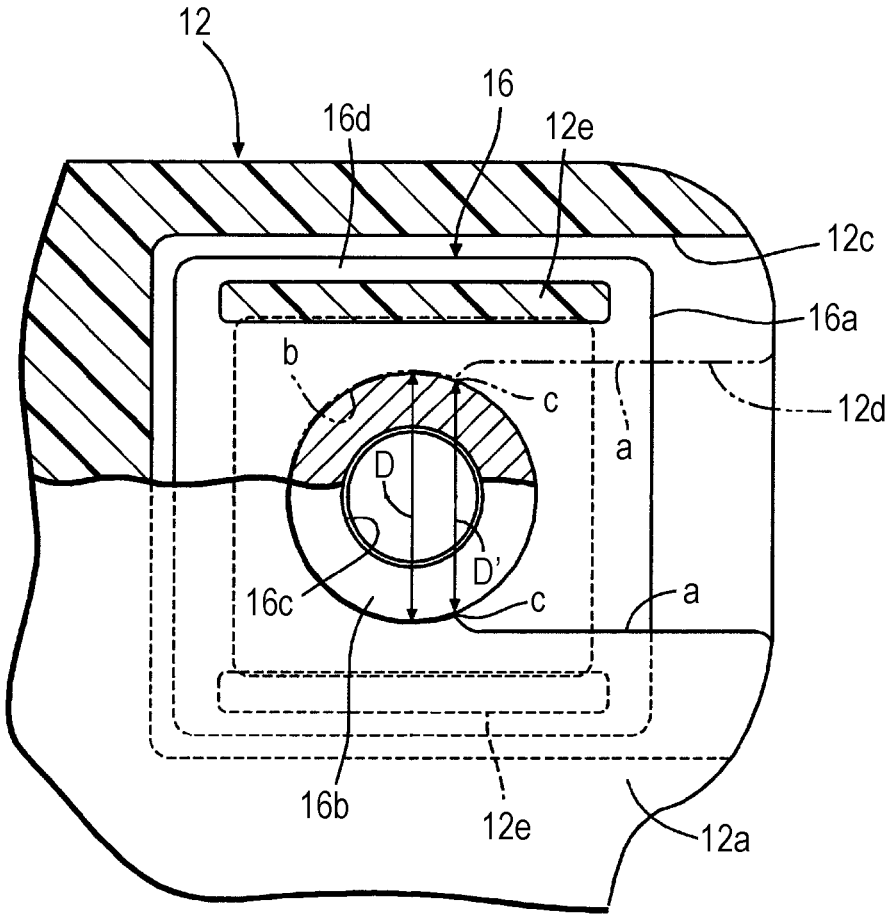
FIG. 3 is a cross-sectional view taken along line III-III of FIG. 2.
Figure 4:
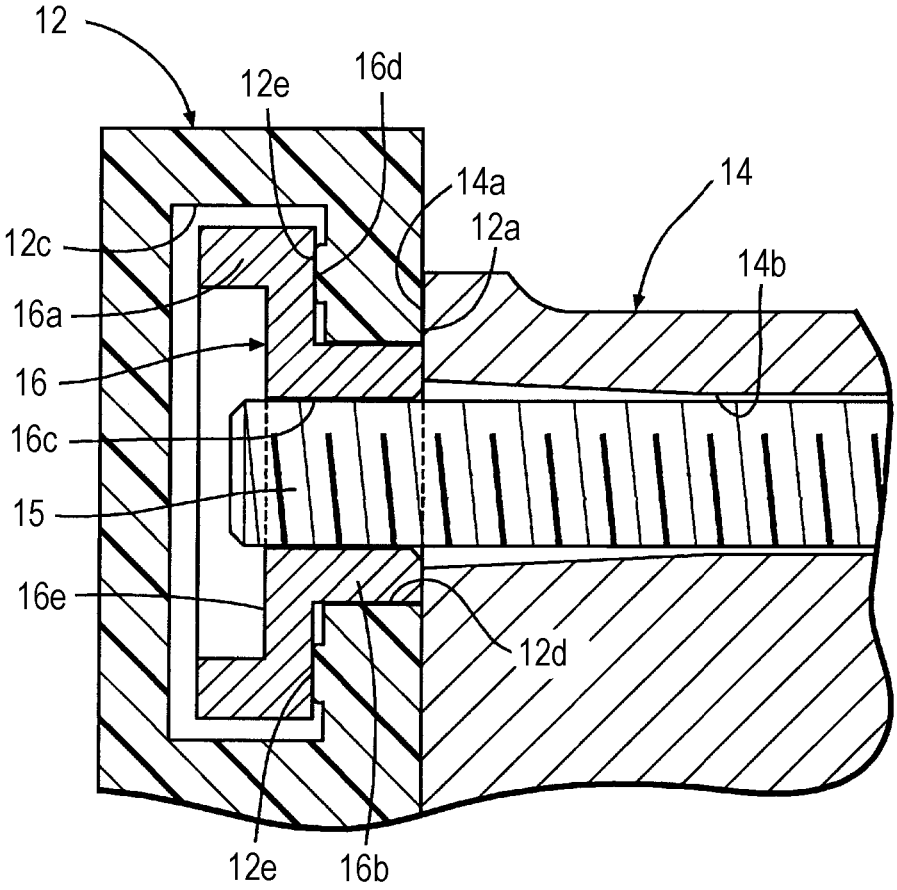
FIG. 4 illustrates first and second flanges after being fastened together according to the first embodiment.

A structure for supporting one of the four nuts 16 in the mounting flange 12 of the intake manifold 11 will now be described with reference to FIG. 1 to FIG. 3. Note that structures for supporting the four nuts 16 are identical.

Each nut 16 has a square plate-like large-diameter portion 16*a*, a cylindrical small-diameter portion 16*b* protruding from the large-diameter portion 16*a* and having a diameter smaller than the length of one side of the large-diameter portion 16*a*, and an internal thread portion 16*c* passing through the large-diameter portion 16*a* and the small-diameter portion 16*b*. The nut 16 has a flat pressing surface 16*d* on the front side of the large-diameter portion 16*a* (i.e., on the side adjacent to the small-diameter portion 16*b*), and a recessed portion 16*e* on the back side of the large-diameter portion 16*a* (i.e., on the side remote from the small-diameter portion 16*b*).

A side face of the mounting flange 12 of the intake manifold 11 has slits, each of which is open for insertion of the corresponding nut 16. The slit includes a first slit 12*c* into which the large-diameter portion 16*a* of the nut 16 is loosely fitted, and a second slit 12*d* into which the small-diameter portion 16*b* of the nut 16 is fitted. The second slit 12*d* communicates with both the first slit 12*c* and the mating surface 12*a*. As illustrated in FIG. 3, the second slit 12*d* has parallel portions "a" and "a" having a width slightly greater than a diameter D of the small-diameter portion 16*b*, and a circular portion (or open portion) "b" communicating with the parallel portions "a" and "a" and having a diameter substantially the same as the diameter D of the small-diameter portion 16*b*. The small-diameter portion 16*b* has a circumference slightly greater than 180°. A distance D' between a pair of retaining portions "c" and "c" formed at positions where the circular portion "b" connects to the parallel portions "a" and "a" is slightly smaller than the diameter D of the small-diameter portion 16*b*.

A wall surface of the first slit 12*c* closer to the second slit 12*d*, that is, the wall surface that faces the pressing surface 16*d* of the nut 16 has two linear raised portions 12*e* and 12*e* extending parallel to the direction of the first and second slits 12*c* and 12*d*.

Bolt holes 14*b* are formed in the mounting flange 14 of the throttle body 13 such that when the mounting flange 14 is brought into contact with the mounting flange 12 into which the nuts 16 have been inserted, each of the bolt holes 14*b* is aligned with the axis of the internal thread portion 16*c* of the corresponding nut 16.

A function of the first embodiment having the above-described configuration will now be described.

To fasten the mounting flange 14 of the throttle body 13 to the mounting flange 12 of the intake manifold 11, first, the four nuts 16 are inserted into the mounting flange 12 of the intake manifold 11. The large-diameter portion 16*a* and the small-diameter portion 16*b* of each nut 16 are inserted along the first slit 12*c* and the second slit 12*d*, respectively, of the mounting flange 12. The small-diameter portion 16*b* moves from the parallel portions "a" and "a" to the circular portion "b" of the second slit 12*d* while elastically deforming the retaining portions "c" and "c". A fit of the small-diameter portion 16*b* to the circular portion "b" can thus be maintained (see FIG. 3). Therefore, in the operation of screwing the four bolts 15 into the respective nuts 16, the nuts 16 can be prevented from falling from the mounting flange 12 of the intake manifold 11. It is thus possible to improve efficiency in assembly operation.

Next, the mating surface 14*a* of the mounting flange 14 of the throttle body 13 is brought into contact with the mating surface 12*a* of the mounting flange 12 of the intake manifold 11. Thus, the bolts 15 in the respective bolt holes 14*b* in the mounting flange 14 of the throttle body 13 are screwed into the respective nuts 16. Before the bolts 15 are tightened, as illustrated in an enlarged view of FIG. 2, there is a clearance between the pressing surface 16*d* of the large-diameter portion 16*a* of the nut 16 and the raised portions 12*e* and 12*e* of the mounting flange 12. At the same time, there is a clearance between an end of the small-diameter portion 16*b* of the nut 16 and the mating surface 14*a* of the mounting flange 14 of the throttle body 13.

Then, when each bolt 15 is tightened, the corresponding nut 16 moves toward the throttle body 13 while compressing the raised portions 12*e* and 12*e* with the pressing surface 16*d*. When the end of the small-diameter portion 16*b* of the metal nut 16 comes into contact with the mating surface 14*a* of the mounting flange 14 of the metal throttle body 13 and a metal touch is established, the tightening of the bolt 15 completes (see FIG. 4). The height of the raised portions 12*e* and 12*e* is set such that the raised portions 12*e* and 12*e* are not completely flattened upon completion of tightening of the bolt 15.

When the mounting flange 12 of the plastic intake manifold 11 and the mounting flange 14 of the metal throttle body 13 are fastened together with the bolts 15 and the nuts 16 as described above, a load applied from the mounting flange 14 of the throttle body 13 to the mounting flange 12 of the intake manifold 11 does not reach the level of repulsive force of the compressed raised portions 12*e* and 12*e* that try to return to their original shape. Therefore, since the mounting flange 12 of the plastic intake manifold 11 can be prevented from being deformed by an excessive tightening load, it is possible to ensure sealing between the mating surfaces 12*a* and 14*a*. It is also possible to prevent degradation of accuracy in controlling the amount of intake air caused by deformation of the throttle body 13.

The two raised portions 12*e* and 12*e* are located on both sides of the small-diameter portion 16*b* of the nut 16. Thus, since inclination of the nut 16 can be prevented by evenly compressing the two raised portions 12*e* and 12*e*, the corresponding bolt 15 can be smoothly screwed into the nut 16. As described above, the rectangular large-diameter portion 16*a* of the nut 16 is fitted into the first slit 12*c* with a small clearance left therebetween. Therefore, when the corresponding bolt 15 is screwed into the nut 16, the corners of the nut 16 interfere with the interior of the first slit 12*c*. Since the nut 16 can thus be prevented from being dragged, it is possible to improve efficiency in screwing the bolt 15 into the nut 16.

As described above, the raised portions 12*e* and 12*e* extend parallel to the direction in which the first slit 12*c* and the second slit 12*d* extend. Therefore, when the intake manifold 11 is formed of plastic in a mold, there is no need to create a mold having a complicated structure, and the intake manifold 11 can be easily removed from the mold.

Figure 5A:
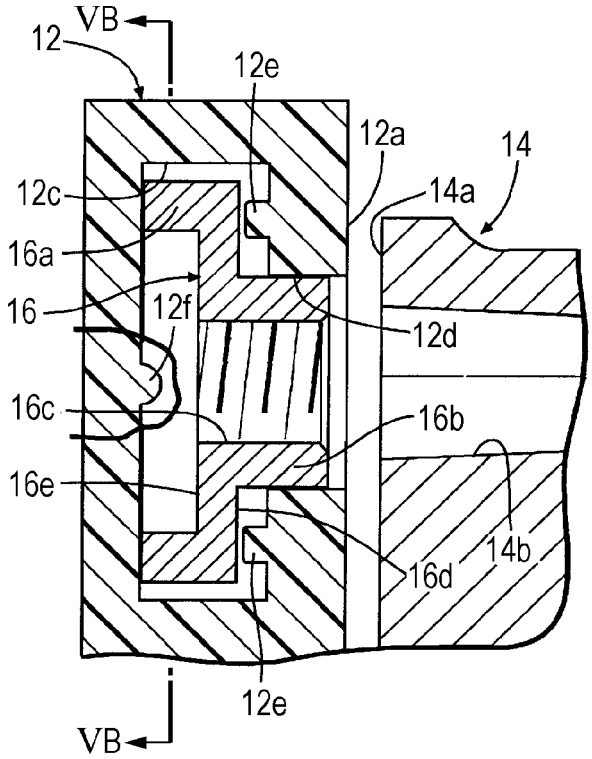
FIG. 5A illustrates a structure in which a nut is supported by the second flange according to a second embodiment of the present invention.
Figure 5B:
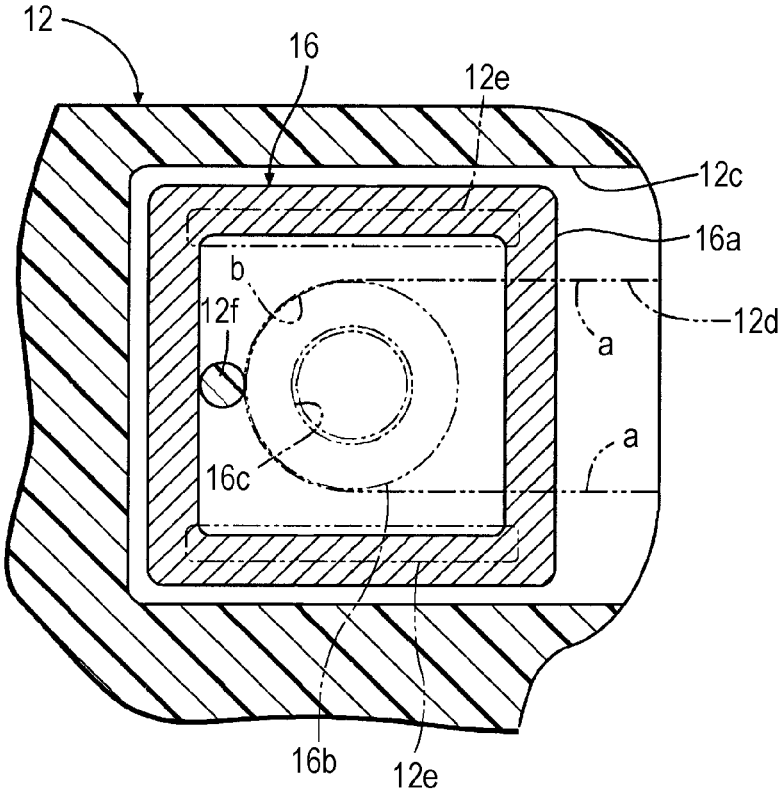
FIG. 5B is a cross-sectional view taken along line VB-VB of FIG. 5A.

A second embodiment of the present invention will now be described with reference to FIG. 5A and FIG. 5B.

In the first embodiment described above, the retaining portions for retainers) "c" and "c" in the second slit 12*d* of the mounting flange 12 of the intake manifold 11 prevent the corresponding nut 16 from falling. In the second embodiment, a retaining protrusion (or retainer) 12*f* formed inside the first slit 12*c* and facing the recessed portion 16*e* of the nut 16 prevents the nut 16 from falling.

Specifically, when the large-diameter portion 16*a* of the nut 16 is inserted into the first slit 12*c*, the edge of the large-diameter portion 16*a* passes over the retaining protrusion 12*f* while elastically deforming the retaining protrusion 12*f*. Since the retaining protrusion 12*f* is thus brought into engagement with the interior of the recessed portion 16*e*, the nut 16 can be prevented from falling.

Figure 6:
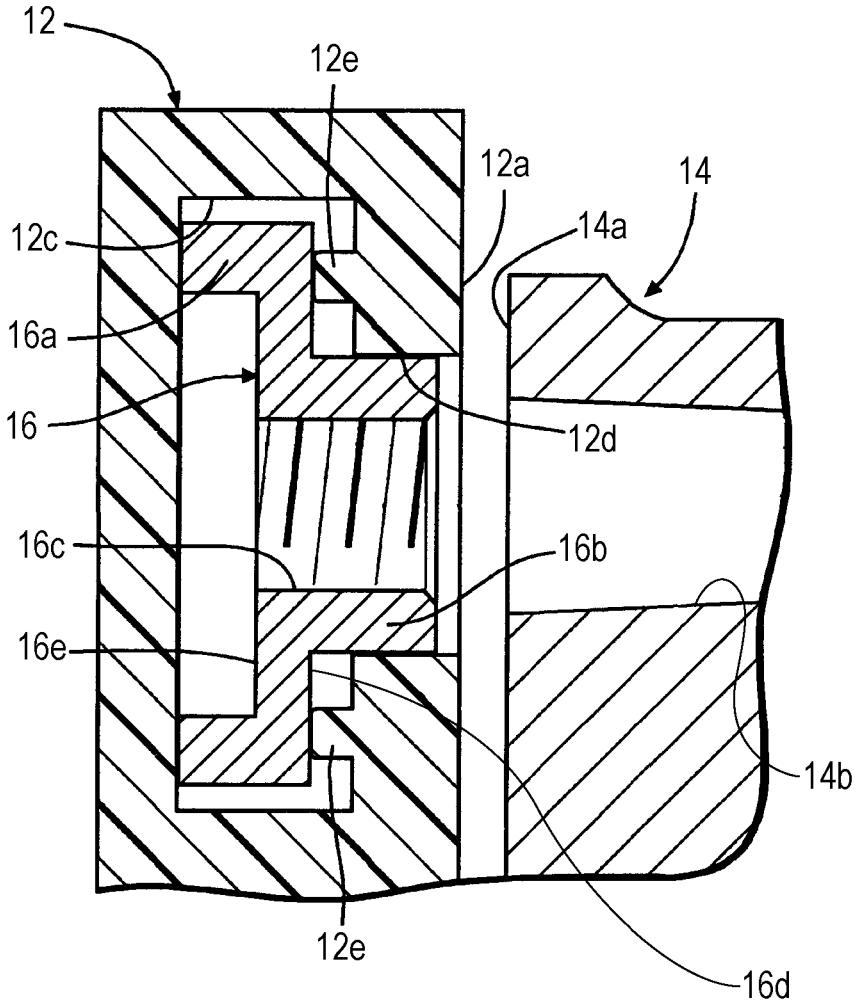
FIG. 6 illustrates a structure in which a nut is supported by the second flange according to a third embodiment of the present invention.

A third embodiment of the present invention will now be described with reference to FIG. 6.

In the first and second embodiments described above, when the large-diameter portion 16*a* of the nut 16 is inserted into the first slit 12*c*, there is a clearance between the pressing surface 16*d* of the nut 16 and the raised portions 12*e* and 12*e*. In the third embodiment, the pressing surface 16*d* of the nut 16 and the raised portions 12*e* and 12*e* are configured to slide at a predetermined surface pressure. Thus, the resulting frictional force between the sliding portions prevents the nut 16 from falling.

Figure 7:
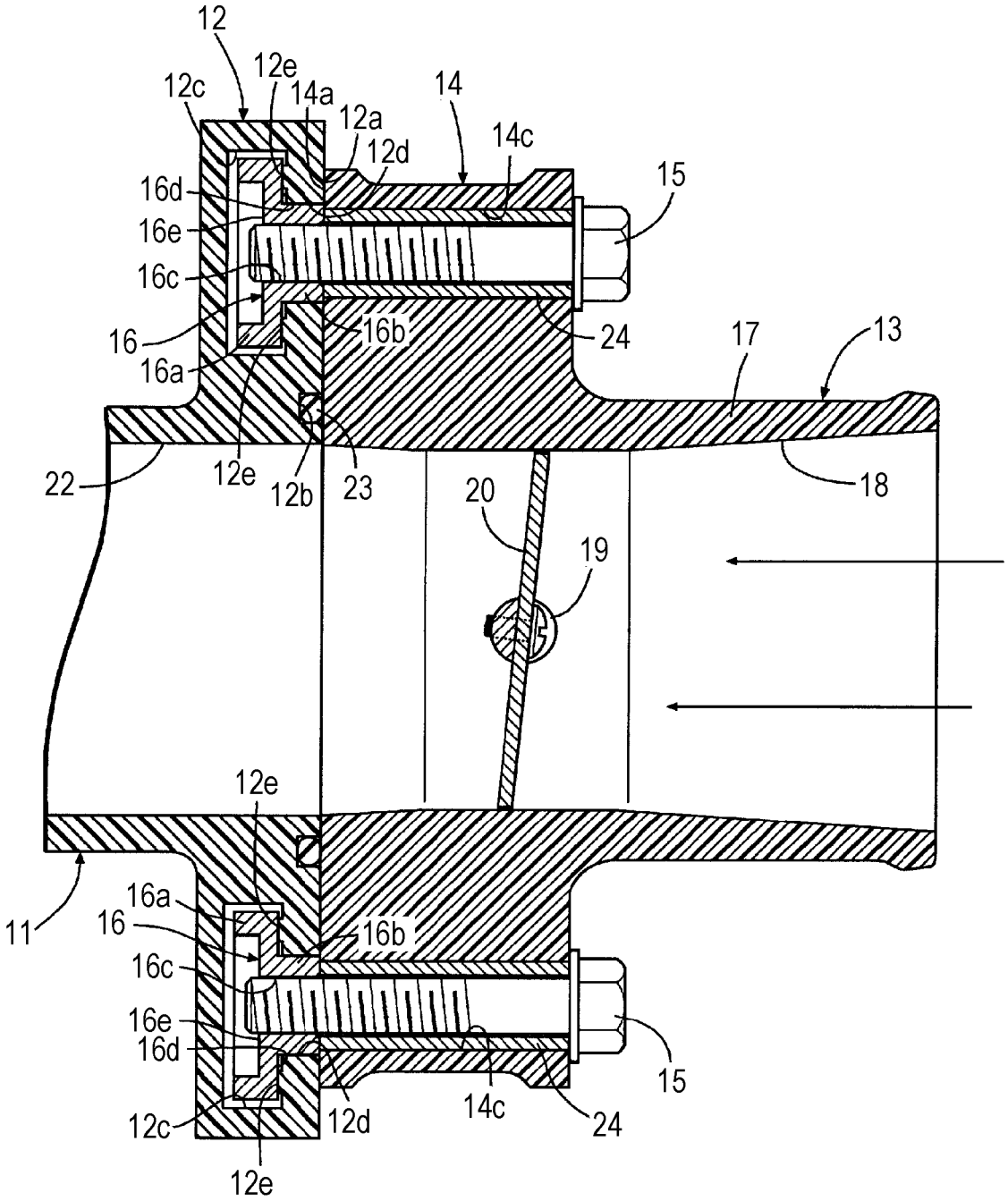
FIG. 7 illustrates the first and second flanges after being fastened together according to a fourth embodiment of the present invention.

A fourth embodiment of the present invention will now be described with reference to FIG. 7.

In the first embodiment described above, the intake manifold 11 is of plastic and the throttle body 13 is of aluminum alloy. In the fourth embodiment, however, both the intake manifold 11 and the throttle body 13 are of plastic.

The mounting flange 14 of the throttle body 13 has through holes 14*c* having a predetermined diameter, instead of the bolt holes 14*b* (see FIG. 2) of the first embodiment. As illustrated in FIG. 7, collars 24 are disposed in the respective through holes 14*c*. The length of each collar 24 is set to be equal to the thickness of the mounting flange 14 (i.e., the length of the through holes 14*c*).

Therefore, when each bolt 15 is screwed into the corresponding nut 16 and tightened, both ends of the collar 24 metallically touch the head of the bolt 15 and the small-diameter portion 16*b* of the nut 16. Thus, the mounting flange 14 of the plastic throttle body 13 can be prevented from being deformed by an excessive fastening load applied thereto. Additionally, as in the case of the first embodiment, a fastening load applied to the mounting flange 12 of the plastic intake manifold 11 can be limited by compression of the raised portions 12*e* and 12*e*.

In the fourth embodiment, since deformation of both the mounting flange 12 of the plastic intake manifold 11 and the mounting flange 14 of the plastic throttle body 13 can be prevented, it is possible to ensure sealing between the mating surfaces 12*a* and 14*a* of the mounting flanges 12 and 14. At the same time, it is possible to prevent degradation of accuracy in controlling the amount of intake air caused by deformation of the throttle body 13.

Figure 8:
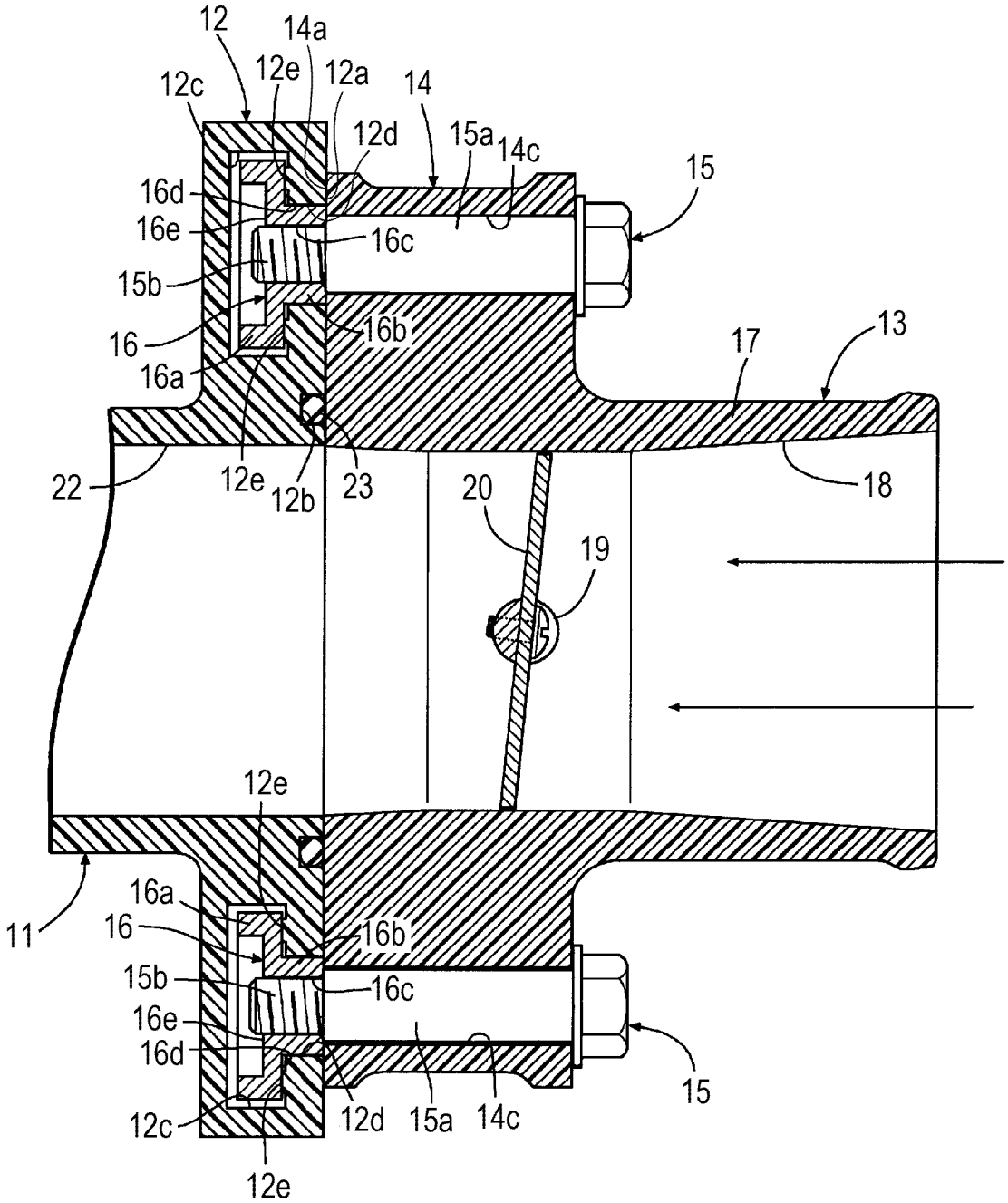
FIG. 8 illustrates the first and second flanges after being fastened together according to a fifth embodiment of the present invention.

A fifth embodiment of the present invention will now be described with reference to FIG. 8.

The fifth embodiment is a modification of the fourth embodiment described above. Instead of the bolts 15 of the fourth embodiment, stepped bolts 15, each being a combination of the bolt 15 and the collar 24 described above, are used in the fifth embodiment. The stepped bolt 15 has a thick shaft portion 15*a* having a predetermined diameter and a thin shaft portion 15*b* having an external thread. The length of the thick shaft portion 15*a* is set to be equal to the thickness of the mounting flange 14 (i.e., the length of the through holes 14*c*).

In the fifth embodiment, when each stepped bolt 15 is screwed into the corresponding nut 16 and tightened, the thick shaft portion 15*a* of the stepped bolt 15 metallically touches the small-diameter portion 16*b* of the nut 16. Thus, it is possible to achieve functions and effects similar to those of the fourth embodiment while reducing the number of components by not using the collars 24.

Although the embodiments of the present invention have been described above, the design of the present invention can be changed variously without departing from the scope of the present invention.

For example, although the first member and the second member are the throttle body 13 and the intake manifold 11, respectively, in the embodiments described above, the first and second members of the present invention are not limited to the throttle body 13 and the intake manifold 11.

Also, in the embodiments described above, the bolts 15 are inserted from the side of the throttle body 13 and screwed into the respective nuts 16 provided on the side of the intake manifold 11. Alternatively, the bolts 15 may be inserted from the side of the intake manifold 11 and screwed into the respective nuts 16 provided on the side of the throttle body 13.

Although the throttle body 13 is of aluminum alloy in the first embodiment described above, the throttle body 13 may be of any metal other than aluminum alloy.

Although two raised portions 12*e* and 12*e* are provided for each of the nuts 16 in the embodiments described above, their number is not limited to two.

The two raised portions 12*e* and 12*e* provided for each of the nuts 16 in the embodiments described above are linear in shape and parallel to each other. Alternatively, the raised portions 12*e* and 12*e* may be angular U-shaped or of other shape. Each of the raised portions 12*e* and 12*e* may not be linear, and may be a collection of point-like protrusions.

In the embodiments described above, the large-diameter portion 16*a* of each nut 16 has a rectangular shape for antirotational purposes. Alternatively, the large-diameter portion 16*a* may have any polygonal shape other than a rectangular shape.

According to the embodiment of the present invention, a flange fastening structure includes bolts and nuts. A first flange of metal on a first member and a second flange of plastic on a second member are joined and fastened together with the bolts and the nuts. Each of the nuts inserted into the second flange is a stepped nut that has a large-diameter portion in contact with the second flange and a small-diameter portion extending from the large-diameter portion and in contact with the first flange. A raised portion of plastic is formed on a surface of the second flange facing the large-diameter portion. A fastening position of the nut and the corresponding bolt is limited by contact of the small-diameter portion with the first flange at the time of fastening of the first flange and the second flange. This can prevent deformation of the first and second flanges. A height of the raised portion is set such that the raised portion pressed by the large-diameter portion at the fastening position is deformed by a predetermined amount. Therefore, the second flange of plastic can be prevented from loosening, and reliable fastening of the first and second flanges can be ensured.

According to the embodiment of the present invention, a flange fastening structure includes bolts and nuts. A first flange of plastic on a first member and a second flange of plastic on a second member are joined and fastened together with the bolts and the nuts. Each of the bolts is fitted into a metal collar having a length substantially the same as a thickness of the first flange to pass through the first flange. Each of the nuts inserted into the second flange is a stepped nut that has a large-diameter portion in contact with the second flange and a small-diameter portion extending from the large-diameter portion and in contact with the collar. A raised portion of plastic is formed on a surface of the second flange facing the large-diameter portion. A fastening position of the nut and the corresponding bolt is limited by contact of the small-diameter portion with the collar at the time of fastening of the first flange and the second flange. This can prevent deformation of both the first and second flanges of plastic. A height of the raised portion is set such that the raised portion pressed by the large-diameter portion at the fastening position is deformed by a predetermined amount. Therefore, the second flange of plastic can be prevented from loosening, and reliable fastening of the first and second flanges can be ensured.

According to the embodiment of the present invention, a flange fastening structure includes bolts and nuts. A first flange of plastic on a first member and a second flange of plastic on a second member are joined and fastened together with the bolts and the nuts. Each of the bolts passing through the first flange is a stepped bolt that has a thick shaft portion having a length substantially the same as a thickness of the first flange and a thin shaft portion extending from the thick shaft portion and screwed into the corresponding nut. Each of the nuts inserted into the second flange is a stepped nut that has a large-diameter portion in contact with the second flange and a small-diameter portion extending from the large-diameter portion and in contact with the thick shaft portion. A raised portion of plastic is formed on a surface of the second flange facing the large-diameter portion. A fastening position of the nut and the corresponding bolt is limited by contact of the small-diameter portion with the thick shaft portion at the time of fastening of the first flange and the second flange. This can prevent deformation of both the first and second flanges of plastic. A height of the raised portion is set such that the raised portion pressed by the large-diameter portion at the fastening position is deformed by a predetermined amount. Therefore, the second flange of plastic can be prevented from loosening, and reliable fastening of the first and second flanges can be ensured.

According to the embodiment of the present invention, the second flange may have a slit into which each nut is inserted, the slit extending in a direction substantially orthogonal to a direction of insertion of the corresponding bolt. Thus, the first and second flanges can be tightly fastened together by screwing the bolts into the respective nuts. Additionally, the large-diameter portion of each nut may have a polygonal shape to limit rotation of the nut inside the slit. It is thus possible to prevent the nut from being dragged by rotation of the corresponding bolt and to improve efficiency in screwing operation.

According to the embodiment of the present invention, the raised portion may extend in a direction of insertion of the nut. Therefore, when the second member is formed of plastic in a mold, the second member can be easily removed from the mold, and the structure of the mold can be simplified. The raised portion may be provided in a plurality on both sides of the small-diameter portion. It is thus possible to prevent inclination of the nut inside the slit and to ensure reliable fastening of the first and second flanges.

According to the embodiment of the present invention, the second flange may have a retainer that engages with the nut inserted into the slit. Thus, it is possible to prevent the nut from falling from the slit during the operation of screwing the corresponding bolt into the nut, and to improve efficiency in the operation.

According to the embodiment of the present invention, the small-diameter portion may be cylindrical in shape, the slit may have an opening into which the small-diameter portion is fitted, and a width of an entrance of the opening may be smaller than a diameter of the small-diameter portion. Thus, since the nut does not easily fall off once fitted into the opening, it is possible to improve efficiency in the operation of screwing the corresponding bolt into the nut.

According to the embodiment of the present invention, one of the first member and the second member may be an intake manifold for an internal-combustion engine, and the other of the first member and the second member may be a throttle body for the internal-combustion engine. Therefore, by preventing the deformation of the first and second flanges fastened together with the bolts and the nuts, it is possible to improve sealing between mating surfaces of the first and second flanges, suppress deformation of the throttle body, and improve accuracy in controlling the amount of intake air.

Obviously, numerous modifications and variations of the present invention are possible in light of the above teachings. It is therefore to be understood that within the scope of the appended claims, the invention may be practiced otherwise than as specifically described herein.

What is claimed is:

1. A flange fastening structure comprising:

bolts;

a first flange made of metal and provided on a first member;

a second flange made of plastic and provided on a second member;

stepped nuts provided in the second flange and each having a large-diameter portion in contact with the second flange and a small-diameter portion extending from the large-diameter portion;

the second flange having a surface facing the large-diameter portion and facing away from the first flange, the second flange having openings through which the small-diameter portions extend, and the second flange having at least one raised portion protruding from the surface in a direction extending away from the first flange and at a location that is spaced apart from an edge of the openings, the at least one raised portion being made of plastic, a height of the at least one raised portion being set such that the at least one raised portion pressed with the large-diameter portion is deformed by a predetermined amount when the first flange and the second flange are fastened together with the bolts and the nuts; and the small-diameter portion of each of the nuts contacting the first flange to limit fastening positions of the nuts and the bolts corresponding to the nuts respectively when the first flange and the second flange are fastened together with the bolts and the nuts.

2. The flange fastening structure according to claim 1, wherein the second flange has slits into which the nuts are respectively inserted, the slits extending in a direction substantially orthogonal to a direction of insertion of the bolts and including the openings, and wherein the large-diameter portion has a polygonal shape to limit rotation of each of the nuts inside the slits.

3. The flange fastening structure according to claim 2, wherein the at least one raised portion longitudinally extends in a direction of insertion of the nuts into the slits, and wherein the at least one raised portion includes two raised portions provided on the second flange at locations on opposite sides of the small-diameter portion when the nuts are inserted into the slits.

4. The flange fastening structure according to claim 2, wherein the second flange has retainers that engage with the nuts inserted into the slits, respectively.

5. The flange fastening structure according to claim 4, wherein the small-diameter portion has a cylindrical shape, wherein each of the slits has an opening into which the small-diameter portion is fitted, and wherein a width of an entrance of the opening is smaller than a diameter of the small-diameter portion.

6. The flange fastening structure according to claim 4, wherein the retainer comprises the at least one raised portion.

7. The flange fastening structure according to claim 4, wherein the retainer comprises a recessed portion provided in a surface of the large-diameter portion opposite to a surface having the small-diameter portion, and a protrusion provided inside a slit among the slits in the second flange and facing the recessed portion.

8. The flange fastening structure according to claim 1, wherein one of the first member and the second member comprises an intake manifold for an internal-combustion engine, and another of the first member and the second member comprises a throttle body for the internal-combustion engine.

9. The flange fastening structure according to claim 1, wherein the second flange has slits into which the nuts are respectively received, and wherein the surface and the at least one raised portion protruding from the surface are provided on inner portions of the slits.

10. The flange fastening structure according to claim 1, wherein each stepped nut is a single unitary body including both the large-diameter portion and the small-diameter portion.

11. The flange fastening structure according to claim 1, wherein, in an assembled state in which the first flange and the second flange are fastened together with the bolts and the nuts, the at least one raised portion is elastically deformed from a first height to a second height shorter than the first height.

12. The flange fastening structure according to claim 1, wherein the stepped nuts each include a planar pressing surface on the large-diameter portion thereof, and wherein the at least one raised portion is configured to abut the planar pressing surface when the first flange and the second flange are fastened together with the bolts and the nuts.

* * * * *